US005222673A

United States Patent [19]

Reiter

[11] Patent Number: 5,222,673

[45] Date of Patent: Jun. 29, 1993

[54] ELECTROMAGNETICALLY ACTUATED FUEL INJECTION VALVE HAVING A STOP PIN FOR A BALL-SHAPED VALVE BODY

[75] Inventor: Ferdinand Reiter, Markgroeningen, Fed. Rep. of Germany

[73] Assignee: Robert Bosch GmbH, Stuttgart, Fed. Rep. of Germany

[21] Appl. No.: 778,105

[22] PCT Filed: Mar. 22, 1991

[86] PCT No.: PCT/DE93/00250

§ 371 Date: Dec. 13, 1991

§ 102(e) Date: Dec. 13, 1991

[87] PCT Pub. No.: WO91/17356

PCT Pub. Date: Nov. 14, 1991

[30] Foreign Application Priority Data

Apr. 30, 1990 [DE] Fed. Rep. of Germany ..... 4013832

[51] Int. Cl.[5] ..... F02M 51/06; F02M 61/04; F16K 31/06

[52] U.S. Cl. ..... 239/585.1; 239/900

[58] Field of Search ..... 239/585.1, 900; 251/129.15, 129.18

[56] References Cited

U.S. PATENT DOCUMENTS

| | | | |
|---|---|---|---|
| 3,001,757 | 9/1961 | Ball . | |
| 3,731,880 | 5/1973 | Williams | 239/585.1 |
| 4,130,095 | 12/1978 | Bowler et al. . | |
| 4,306,683 | 12/1981 | Mallinson . | |
| 4,621,772 | 11/1986 | Blythe et al. | 239/900 X |
| 4,655,396 | 4/1987 | Taxon et al. | 239/900 X |
| 4,733,822 | 3/1988 | Romann | 239/900 X |
| 4,887,769 | 12/1989 | Okamoto et al. | 239/900 X |
| 5,054,691 | 10/1991 | Huang et al. | 239/900 X |

FOREIGN PATENT DOCUMENTS

| | | |
|---|---|---|
| 0063952 | 11/1982 | European Pat. Off. . |
| 0296628 | 12/1988 | European Pat. Off. . |
| 3704541 | 9/1988 | Fed. Rep. of Germany . |
| 3833079 | 4/1990 | Fed. Rep. of Germany . |
| 2057193 | 3/1981 | United Kingdom . |
| 2225810 | 6/1990 | United Kingdom . |

*Primary Examiner*—Andres Kashnikow
*Assistant Examiner*—William Grant
*Attorney, Agent, or Firm*—Edwin E. Greigg; Ronald E. Greigg

[57] ABSTRACT

A fuel injection valve including a blind hole in a stepped inner pole from which a stop pin extends into a passage hole of an armature which is designed with a tubular blind bore. In the open position of the fuel injection valve, a ball-shaped valve closing body is in contact with the stop pin. The armature is directly connected to the valve closing body so that there is a very short moving valve part. The fuel injection valve of the invention not only has good dynamic behavior but also has a short and compact installation shape. The fuel injection valve is particularly suitable for fuel injection systems of mixture-compressing externally ignited internal combustion engines.

21 Claims, 2 Drawing Sheets

Figure 1:
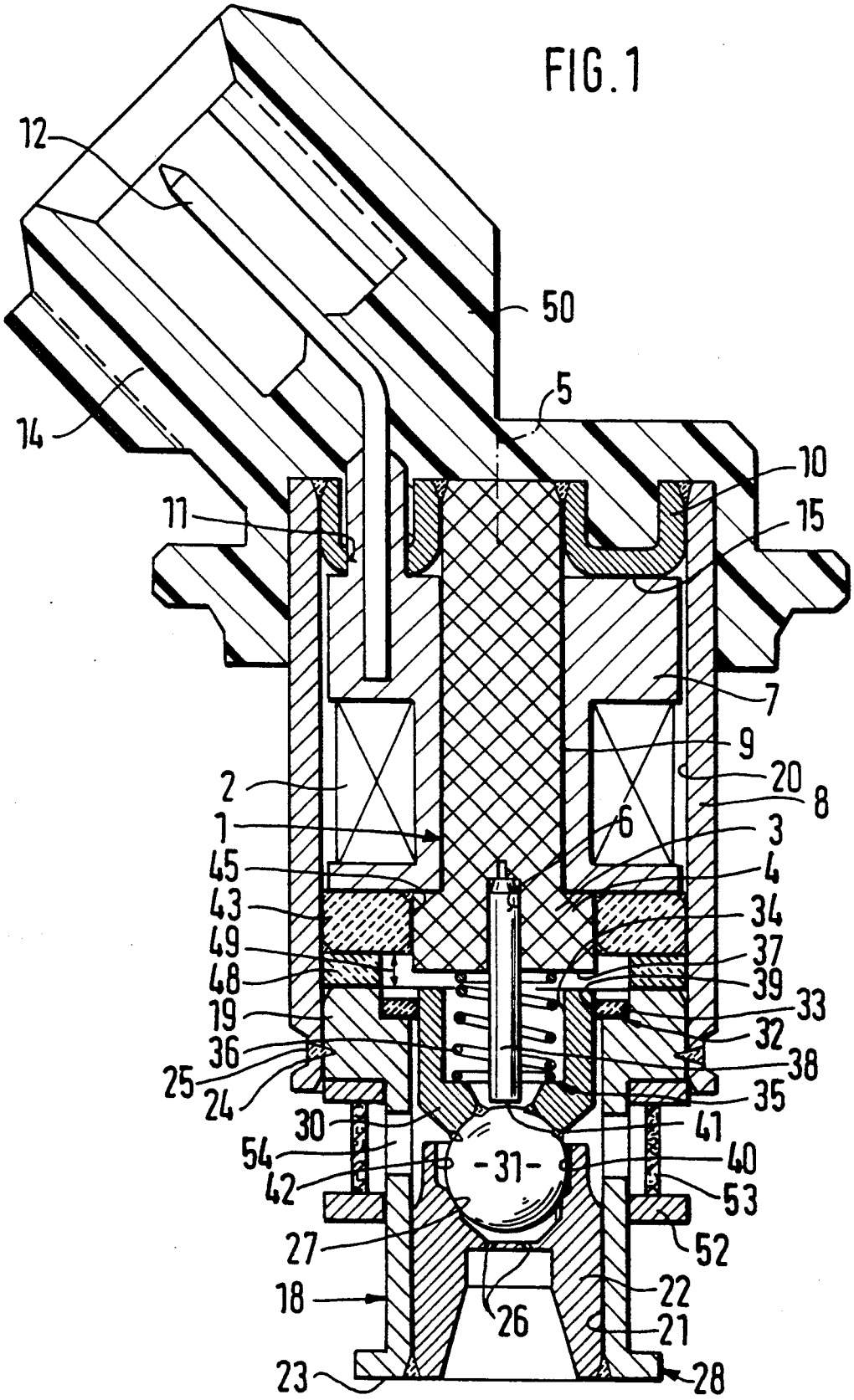

12
50
5
14
10
11
15
7
9
20
2
8
1
6
3
45
4
43
34
49
37
48
39
19
33
36
32
25
38
24
35
30
41
54
40
42
31
53
27
52
18
22
26
21
23
28

14
5
10
7
9
2
20
1
8
6
68
3
66
4
70
69
45
43
65
64
48
39
19
76
75
77
36
38
30
54
-31-
27
18
26
21
22
23
61
60

ELECTROMAGNETICALLY ACTUATED FUEL INJECTION VALVE HAVING A STOP PIN FOR A BALL-SHAPED VALVE BODY

STATE OF THE ART

The invention is based on an electromagnetically actuated fuel injection valve. An electromagnetically actuated fuel injection valve, in which a stop pin is located in a blind hole of the inner pole extending concentrically with the valve longitudinal axis, is already known from U.S. Pat. No. 4,646,974. The opening displacement of the valve needle, which interacts with a fixed valve seat and has the armature at one end and the valve closing body at the other, is limited because the end surface of the valve needle remote from the valve closing body is in contact with the stop pin. The valve needle has a great length and the fuel injection valve therefore has a large installation volume. The large mass of the valve needle leads, furthermore, to poor dynamic behaviour of the fuel injection valve. In the event of a possible oblique attitude of the valve needle, the danger of opening strokes which differ from one another and of jamming of the valve needle cannot be excluded because of the great length.

ADVANTAGES OF THE INVENTION

The electromagnetically actuated fuel injection valve of the invention has, in contrast, the advantage of a particularly compact installation shape because the stop pin protrudes into the passage hole of the armature and acts directly on the valve closing body. The resulting light and compact design of the moving valve part leads to good dynamic behaviour and good long-term running behaviour of the fuel injection valve.

The danger that an oblique attitude of the moving valve part comprising the valve closing body and the armature can lead to different opening strokes of the valve closing body is prevented by the stop pin being directly in contact with the valve closing body in the open position of the latter.

Advantageous extensions and improvements to the prior art valve are possible by means of the measures listed hereinafter.

It is advantageous for a connecting ring to be located on the side of the magnet coil facing towards the armature, this connecting ring having a leak-tight connection, at its inner opening, with the inner pole. This has the effect that no fuel can reach the magnet coil between the inner pole and the connecting ring.

It is particularly advantageous for the connecting ring to have a leak-tight connection, at its periphery, with a valve casing of the fuel injection valve so that the magnet coil is completely sealed against the fuel and does not come into contact with it.

It is also, however, advantageous for the connecting ring to have an L-shaped cross-section, in order to form an annular chamber on the side of the magnet coil facing towards the armature, so that the radially extending side surfaces are formed by a coil carrier part of the magnet coil and by an annular shoulder of the connecting ring and the axially extending side surfaces are formed by the periphery of the connecting ring and by a longitudinal opening in the valve casing. A sealing ring is located in the annular chamber. In this way, safe and reliable sealing is provided between the connecting ring and the valve casing and, therefore, the magnet coil is sealed against the fuel.

It is advantageous for the connecting ring to be formed from a non-magnetic material with a high specific electrical resistance so that the influence of the connecting ring on the magnetic field is very small and the occurrence of additional eddy current losses is prevented.

It is particularly advantageous for the connecting ring to be formed from a ceramic material which is nonmagnetic and has, in addition, a high specific electrical resistance.

It is advantageous for the armature to be directly connected to the ball-type valve closing body so that the moving valve part is particularly light and compact and can, furthermore, be manufactured in a simple manner. A low mass of the moving valve part permits good dynamic behaviour and good long-term running behaviour of the fuel injection valve.

It is particularly advantageous for a flange to be formed on the end of the inner pole facing towards the valve closing body, this flange having a leak-tight connection, at its periphery, with the connecting ring. The stepped inner pole, having only the blind hole to accommodate the stop pin, permits a small inner pole cross-section, limited to the magnetic requirements, so that, with the resulting small coil diameter and a large pole area of the inner pole, there is a large magnetic force when the magnet coil is excited. In addition, the stepped inner pole contributes to the compact design of the fuel injection valve.

It is advantageous for at least one non-magnetic distance washer, which determines the stroke of the valve closing body, to be located in the axial direction between the connecting ring and an end surface, facing towards the magnet coil, of a tubular nozzle carrier, which is connected to the valve casing and in the acceptance hole of which the nozzle body having the fixed valve seat is located. The at least one non-magnetic distance washer permits simple setting of the stroke of the valve closing body and, therefore, of the dynamic fuel quantity sprayed by the fuel injection valve during the opening and closing strokes of the valve closing body, without the danger of the magnetic circuit being influenced by the distance washer.

It is then advantageous for the distance washer to be formed from a ceramic material which is non-magnetic.

It is advantageous for a circular ring-shaped housing cover, which is connected at the outside to the valve casing and at the inside to the inner pole, to be located above the magnet coil in the radial direction between the valve casing and the inner pole so that the fuel injection valve is securely closed at the top.

It is particularly advantageous for the housing cover to be formed from deep-drawn ferritic sheet metal and to have punched passages for the contact tabs contacting the magnet coil so that the housing cover can be formed simply and at low cost.

For the same reason, it is also advantageous for the circular ring-shaped housing cover to have a U-shaped cross-section, the bottom of which faces towards the magnet coil.

It is advantageous for a tubular filler part to be located on the periphery of the stop pin protruding from the blind hole of the inner pole, which filler part is used for guiding the return spring and reduces the space through which fuel flows upstream of the spray openings.

DRAWING

Illustrative examples of the invention are shown simplified in the drawing and are explained in more detail in the following description. FIG. 1 shows a first illustrative example and FIG. 2 a second illustrative example of a fuel injection valve designed according to the invention.

DESCRIPTION OF THE ILLUSTRATIVE EXAMPLES

The electromagnetically actuated fuel injection valve for fuel injection systems of mixture-compressing, externally ignited internal combustion engines, shown as an example in FIG. 1, has a stepped inner pole 1 of ferromagnetic material which is partially surrounded in a coil section 9 by a magnet coil 2. A flange 4 which has a blind hole 6 concentric with a valve longitudinal axis 5 is formed at its lower pole end 3. The stepped shape of the inner pole 1 permits a small cross-section, relative to the flange 4, of the coil section 9 of the inner pole 1, the cross-section being limited to the magnetic requirements, so that the diameter of the magnet coil 2 can also be kept small and, in consequence, the fuel injection valve can be of compact design.

The magnet coil 2, with its coil carrier part 7, is surrounded by a valve casing 8 which extends in the axial direction below the flange 4 of the inner pole 1. Above the magnet coil 2, at the end remote from the flange 4 of the inner pole 1, is located, in the radial direction between the inner pole 4 and the valve casing 8, a circular ring-shaped housing cover 10 which is connected at the outside to the valve casing 8 and at the inside to the inner pole 1 by means of welding or brazing, for example, so that the fuel injection valve is securely closed at the top. The housing cover 10 is, for example, formed from deep-drawn ferritic sheet metal and has punched passages 11 through which extend contact tabs 12 which, starting from an electrical connecting plug 14, electrically contact the magnet coil 2. A bottom 15 of the circular ring-shaped housing cover 10, which has a U-shaped cross-section, faces towards the magnet coil 2 and the coil carrier part 7.

An upper flange section 19 of a nozzle carrier 18 protrudes into an end, remote from the housing cover 10, of a longitudinal opening 20, formed concentrically with the valve longitudinal axis 5, of the valve casing 8. The flange section 19 is connected to the valve casing 8 by, for example, a welded seam 25 extending in a cross-section reduction 24 of the valve casing 8. In an acceptance hole 21, formed concentrically with the valve longitudinal axis 5, the nozzle carrier 18 has, remote from the magnet coil 2, a nozzle body 22 which is connected to the nozzle carrier 18, on its end surface 23, remote from the magnet coil 2, by, for example, welding. The nozzle body 22 has, for example, two spray openings 26 which are formed downstream of a fixed valve seat 27.

A tubular armature 30 protrudes into the acceptance hole 21 of the nozzle body 18 and interacts with the pole end 3 of the inner pole 1. At its end facing towards the valve seat 27, the armature 30 is directly connected to a ball-shaped valve closing body 31, for example by welding or brazing, which valve closing body 31 interacts with the valve seat 27. The compact and very light moving valve part consisting of the tubular armature 30 and the ball-type valve closing body 31 not only permits good dynamic behaviour and good long-term running behaviour of the fuel injection valve, it also permits a particularly short and compact installation shape of the fuel injection valve.

A guide ring 33, which is formed from a non-magnetic, for example ceramic material, so that the magnetic field of the fuel injection valve is not affected, is located on a retention shoulder 32 of the acceptance opening 21 at the end remote from the nozzle body 22 for guidance of the moving valve part, consisting of the armature 30 and the valve closing body 31, in the acceptance opening 21 of the nozzle carrier 18. The guide ring 33 is connected to the retention shoulder 32 of the nozzle carrier 18 by means of brazing, for example. The periphery of the armature 30 is provided with a wear protection layer, at least in the region in contact with the guide ring 33 during the stroke motion of the moving valve part. The guide ring 33 is designed to be narrow in the axial direction and has a guide opening 39, which is concentric with the valve longitudinal axis 5 and through which the armature 30 protrudes with little clearance.

In its stepped passage hole 34 at the end remote from the inner pole 1, the tubular armature 30 has a spring shoulder 35 on which one end of a return spring 36 is supported, the other end being in contact with an end surface 37 of the flange 4 of the inner pole 1. In the blind hole 6 of the flange 4, there is a stop pin 38 which protrudes into the passage hole 34 of the armature 30. In the open position of the fuel injection valve, the valve closing body 31 is in contact with an end surface 41 of the stop pin 38 so that the opening stroke of the valve closing body 31 is limited in a simple manner. In order to ensure good long-term running behaviour, it is not only the valve closing body 31 but also the end surface 41, at least, of the stop pin 38 which has a hardened surface of high surface quality.

The ball-shaped valve closing body 31 is supported so that it can slide in a guide hole 40 formed in the nozzle body 22 upstream of the valve seat 27. The wall of the guide hole 40 is interrupted by fuel ducts 42 for the supply of fuel, which permit a flow of fuel from the acceptance hole 21 to the valve seat 27.

On the side of the magnet coil 2 facing towards the nozzle carrier 18, there is a connecting ring 43 which is located, in the radial direction, between the inner pole 1 and the valve casing 8. This connecting ring 43 is formed from a non-magnetic material with a high specific electrical resistance, such as an austenitic steel or a ceramic material. By this means, the influence of the connecting ring 43 on the magnetic field of the fuel injection valve can be kept very small and the occurrence of additional eddy flow losses can be prevented. At its periphery, the connecting ring 43 is connected in a leak-tight manner, for example by brazing, to the longitudinal opening 20, extending concentrically with the valve longitudinal axis 5, of the valve casing 8 and, at its inner opening 45, to the periphery of the flange 4 of the inner pole 1. This prevents the magnet coil 2 from coming into contact with the fuel.

At least one non-magnetic distance washer 48, formed, for example, from a ceramic material, is located in the axial direction between the connecting ring 43 and the flange section 19 on the end of the nozzle carrier 18 facing towards the magnet coil 2. The axial dimension 49 of the distance washer 48 determines the stroke of the valve closing body 31 and, therefore, the dynamic fuel quantity sprayed from the fuel injection valve during the opening and closing process.

A support ring 52 is located on the periphery of the nozzle carrier 18 which follows on directly from the flange section 19 in the direction towards the spray openings 26, which support ring 52 is designed in two parts so that it can be assembled in the axial direction over a retention shoulder 28, which points radially outwards and is formed on the periphery of the nozzle body 18 at its end facing towards the end surface 23. The support ring 52 has a fuel filter 53 through which fuel can flow from a fuel source to transverse openings 54 which penetrate through the wall of the nozzle carrier 18 in such a way that a fuel flow is possible to the valve seat 27 in the inner space surrounded by the acceptance hole 21.

At least part of the valve casing 8 and all of the housing cover 10 are enclosed by a plastic covering 50 on which is also formed the electrical connecting plug 14 through which the electrical contact and, therefore, the excitation of the magnet coil 2 takes place. The plastic covering 50 can be produced by casting or encapsulating with plastic.

Figure 2:
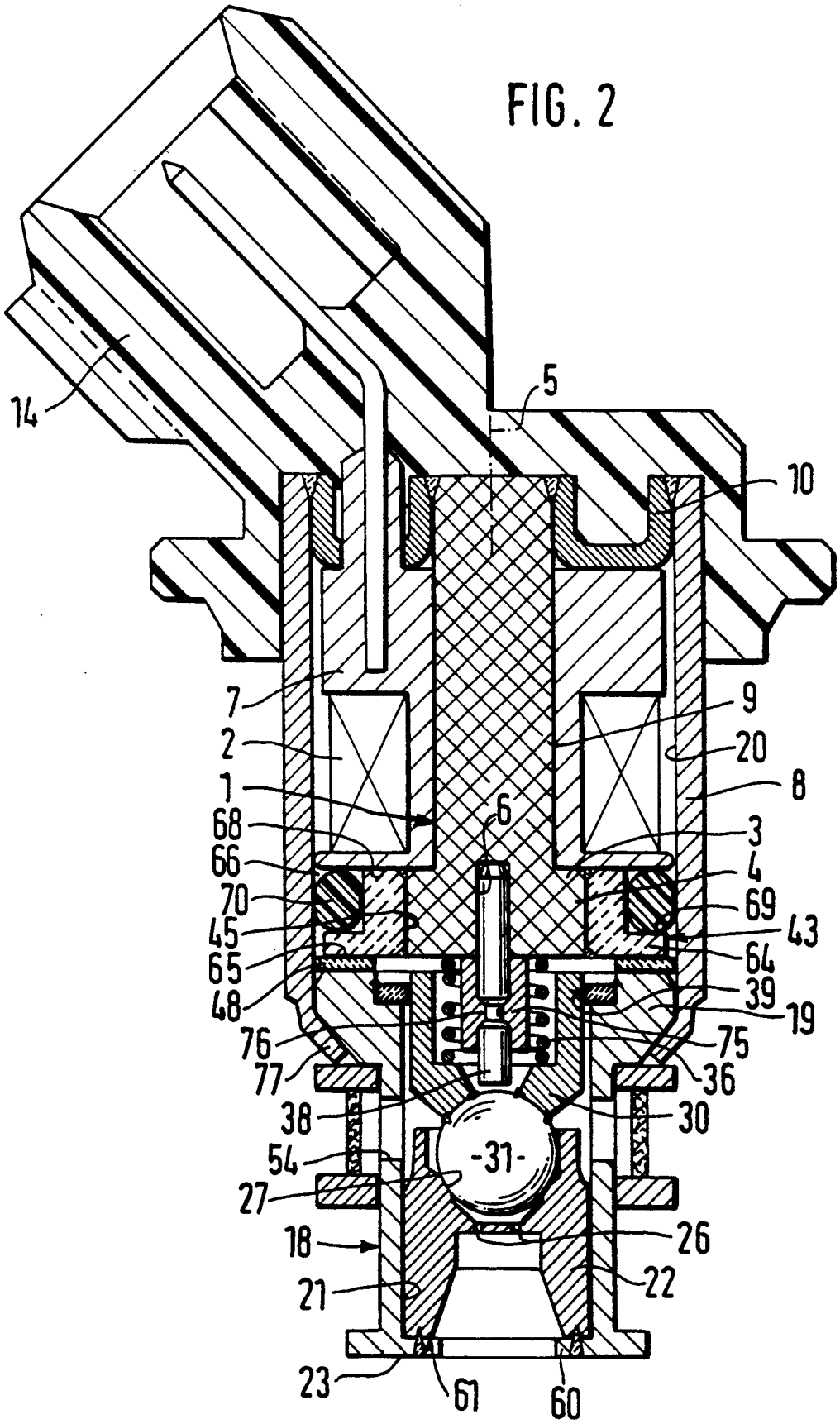

FIG. 2 shows a second illustrative example of the invention in which the same parts and similarly acting parts are designated by substantially the same reference numerals as in FIG. 1. The connecting ring 43 located on the side of the magnet coil 2 facing towards the nozzle carrier 18 has an L-shaped cross-section and is connected, for example, by brazing, at its inner opening 45 to the periphery of the flange 4 of the inner pole 1. The annular shoulder 64 of the connecting ring 43 is in contact with the end surface 65, facing towards the magnet coil 2, of the distance washer 48. The connecting ring 43 is formed, for example, from an austenitic steel or a ceramic material so that the influence of the connecting ring 43 on the magnetic field is very small because of its nonmagnetic material with a high specific electrical resistance. An annular chamber 66 is formed, in the axial direction, between the coil carrier part 7 of the magnet coil 2 and the distance washer 48 by means of the L-shaped cross-section, which is directed towards the outside, of the connecting ring 43. The radially extending side surfaces of the annular chamber 66 are formed by one end surface 68 of the coil carrier part 7 and by an end surface 69, facing towards the magnet coil 2, of the annular shoulder 64 of the connecting ring 43 and the axially extending side surfaces are formed by the periphery of the connecting ring 43 and by the longitudinal opening 20 of the valve casing 8. In order to seal the magnet coil 2 against the fuel, there is a sealing ring 70 located between the valve casing 8 and the connecting ring 43 in the annular chamber 66 so that the magnet coil 2 is sealed by a safe and reliable arrangement which can be easily manufactured.

On the periphery of the stop pin 38 protruding from the blind hole 6 of the inner pole 1, there is a tubular, for example hollow cylindrical-shaped, filler part 75. The filler part 75 is held on the stop pin 38 by means, for example, of a cross-sectional reduction 76 of the stop pin 38 and is manufactured, for example, by spraying plastic around the stop pin 38. It is, however, also possible to hold the filler part 75 on the stop pin 38 by means of a catch or snap connection. In addition to the guidance of the return spring 36 taking place at its periphery, the filler part 75 serves to reduce the volume filled with fuel upstream of the valve seat 27.

The acceptance hole 21, formed concentrically with the valve longitudinal axis 5, of the nozzle carrier 18 is bounded towards the end surfaces 23 of the nozzle carrier 18 by a retention shoulder 60 formed in the acceptance hole 21 and pointing radially inwards. The nozzle body 22 is fitted in the acceptance hole 21 of the nozzle carrier 18 from the side remote from the retention shoulder 60 in such a way that an end surface 61, remote from the valve closing body 31 of the nozzle body 22, is in contact with the retention shoulder 60 and is connected to the latter by welding, for example. The setting of the dynamic fuel quantity sprayed during the opening and closing stroke takes place by changing the stroke of the valve closing body 31 by means of at least one distance washer 48 located, in the axial direction, between the connecting ring 43 and the flange section 19 of the nozzle carrier 18.

Instead of welding the valve casing 8 to the flange section 19 of the nozzle carrier 18, as shown in the first illustrative example, it is also possible, as shown in the second illustrative example, to firmly and reliably connect the reduced cross-section end 77 of the valve casing 8 to the flange section 19 by beading over if the valve casing 8 surrounds the flange section 19 at its end remote from the housing cover 10. For this purpose, the flange section 19 is designed to taper conically towards the transverse openings 54 in the direction of the valve longitudinal axis 5.

The fuel injection valve of the invention, with the stop pin 38, which is centrally located in the inner pole 1, protrudes into the passage hole 34 of the tubular armature 30 and has the valve closing body 31 in contact with it in the open position of the fuel injection valve, permits a particularly short and compact design of the fuel injection valve. The direct connection of the tubular armature 30 with the ball-type valve closing body 31 leads to a particularly compact and light moving valve part, consisting of the armature 30 and the valve closing body 31, so that the fuel injection valve has good dynamic behaviour and good long-term running behaviour.

The foregoing relates to a preferred exemplary embodiment of the invention, it being understood that other variants and embodiments thereof are possible within the spirit and scope of the invention, the latter being defined by the appended claims.

I claim:

1. An electromagnetically actuated fuel injection valve for fuel injection systems of mixture-compressing, externally ignited internal combustion engines having a magnet coil surrounded by a valve casing (8), an inner pole surrounded by said magnet coil, an armature facing towards the inner pole, a valve closing body of substantially spherical form connected directly to said armature, said valve closing body interacts with a fixed valve seat, a stop pin located concentrically with a longitudinal axis of said valve in a blind hole of the inner pole, said stop pin limits an opening displacement of the valve closing body, said armature (30) is designed to be tubular and has a blind bore passage hole (34), said stop pin (38) has a smaller diameter than said passage hole (34) and protrudes into the passage hole (34) and, in an open position of the valve closing body (31), said closing body is directly in contact with the stop pin (38).

2. A fuel injection valve according to claim 1, in which on a side of the magnet coil (2) facing towards the armature (30), there is a connecting ring (43) which has a leak-tight connection, at an inner opening (45) with the inner pole (1).

3. A fuel injection valve according to claim 2, in which the connecting ring (43) has a leak-tight connection, at its periphery, with the valve casing (8) of the fuel injection valve.

4. A fuel injection valve according to claim 3, in which at least one non-magnetic distance washer (48) is located in an axial direction between the connecting ring (43) and an end surface of a tubular nozzle carrier (18) facing towards the magnet coil (2) of a tubular nozzle carrier (18), said at least one washer (48) is connected to the valve casing, (8), and the nozzle body (22) having the fixed valve seat (27) is located in an acceptance hole (31) of the tubular nozzle carrier (18).

5. A fuel injection valve according to claim 2, in which the connecting ring (43) has an L-shaped cross-section.

6. A fuel injection valve according to claim 5, in which on a side of the magnet coil (2) facing towards the armature (30), there is an annular chamber (66) whose radially extending side surfaces are formed by a coil carrier part (7) of the magnet coil (2) and by an annular shoulder (64) of the connecting ring (43) and whose axially extending side surfaces are formed by the periphery of the connecting ring (43) and by a longitudinal opening (20) in the valve casing (8).

7. A fuel injection valve according to claim 6, in which a sealing ring (70) is located in the annular chamber (66).

8. A fuel injection valve according to claim 6, in which the connecting ring (43) is formed from a non-magnetic material having a high specific electrical resistance.

9. A fuel injection valve according to claim 6, in which on an end of the inner pole (1) facing towards the valve closing body (31), there is a flange (4) which has a leak-tight connection at its periphery with the connecting ring (43).

10. A fuel injection valve according to claim 6, in which at least one non-magnetic distance washer (48) is located in an axial direction between the connecting ring (43) and an end surface of a tubular nozzle carrier (18) facing towards the magnet coil (2) of a tubular nozzle carrier (18), said at least one washer (48) is connected to the valve casing (8), and the nozzle body (22) having the fixed valve seat (27) is located in an acceptance hole (21) of the tubular nozzle carrier (18).

11. A fuel injection valve according to claim 2, in which the connecting ring (43) is formed from a non-magnetic material having a high specific electrical resistance.

12. A fuel injection valve according to claim 11, in which the connecting ring (43) is formed from a ceramic material.

13. A fuel injection valve according to claim 2, in which on an end of the inner pole (1) facing towards the valve closing body (31), there is a flange (4) which as a leak-tight connection at its periphery with the connecting ring (43).

14. A fuel injection valve according to claim 2, in which at least one non-magnetic distance washer (48) is located in an axial direction between the connecting ring (43) and an end surface of a tubular nozzle carrier (18) facing towards the magnet coil (2), said at least one washer (48) is connected to the valve casing (8), and a nozzle body (22) having the fixed valve seat (27) is located in an acceptance hole (21) of the tubular nozzle carrier (18).

15. A fuel injection valve according to claim 14, in that the distance washer (40) is formed from a ceramic material.

16. A fuel injection valve according to claim 1, in which the closing body (31) is formed as a ball.

17. A fuel injection valve according to claim 1, in which a circular ring-shaped housing cover (10), which is connected at an outside to the valve casing (8) and at an inside to the inner pole (1), is located above the magnet coil (2) in a radial direction between the valve casing (8) and the inner pole (1).

18. A fuel injection valve according to claim 17, in which the housing cover (10) is formed from deep-drawn ferritic sheet metal and has punched passages (11) for passage of the contact tabs (12) which electrically contact the magnet coil (2).

19. A fuel injection valve according to claim 18, in which the circular ring-shaped housing cover (10) has a U-shaped cross-section, the bottom of which (15) faces towards the magnet coil (2).

20. A fuel injection valve according to claim 17, in which the circular ring-shaped housing cover (10) has a U-shaped cross-section, the bottom of which (15) faces towards the magnet coil (2).

21. A fuel injection valve according to claim 1, in which a tubular filler part (75) is located on the periphery of the stop pin (38) protruding from the blind hole (6) of the inner pole (1).

* * * * *